United States Patent [19]

Banks et al.

[11] Patent Number: 4,844,695

[45] Date of Patent: Jul. 4, 1989

[54] VARIABLE FLOW RADIAL COMPRESSOR INLET FLOW FENCES

[75] Inventors: Ivor Banks, Georgetown; Kari J. Heikurinen, Oakville; John J. Sanderson, Oakville; Donald F. Wilford, Oakville, all of Canada

[73] Assignee: Pratt & Whitney Canada Inc., Quebec, Canada

[21] Appl. No.: 214,970

[22] Filed: Jul. 5, 1988

[51] Int. Cl.[4] ..... F04D 29/46; F04D 29/66

[52] U.S. Cl. ..... 415/161; 415/119; 415/914

[58] Field of Search ..... 415/119, 161, 163, 185, 415/187, DIG. 1; 181/214

[56] References Cited

U.S. PATENT DOCUMENTS

| | | | |
|---|---|---|---|
| 1,846,863 | 2/1932 | Hagen | 415/150 |
| 1,989,413 | 1/1935 | Hagen | 230/114 |
| 2,171,342 | 8/1939 | McMahan | 181/207 |
| 2,440,825 | 5/1948 | Jandasek | 60/54 |
| 2,518,869 | 8/1950 | Corless | 181/64 |
| 2,650,752 | 9/1953 | Hoadley | 415/DIG. 1 |
| 2,689,680 | 9/1954 | Lovesey | 230/114 |
| 2,692,015 | 10/1954 | Breed | 158/77 |
| 2,739,709 | 3/1956 | Kaiser | 209/144 |
| 2,773,553 | 12/1956 | Heurich et al. | 181/42 |
| 2,834,536 | 5/1958 | McDonald | 415/159 |
| 2,976,952 | 3/1961 | Holland, Jr. | 55/306 |
| 3,085,741 | 4/1963 | Burkhardt | 230/127 |
| 3,093,299 | 6/1963 | Hammann et al. | 230/127 |
| 3,221,983 | 12/1965 | Trickler et al. | 230/127 |
| 3,367,273 | 2/1968 | Dodson | 103/88 |
| 3,400,902 | 9/1968 | King | 244/53 |
| 3,583,827 | 6/1971 | Wood | 415/159 |
| 3,642,379 | 2/1972 | Swearingen | 415/119 |
| 3,678,285 | 7/1972 | Griffith | 290/40 |
| 3,819,008 | 6/1974 | Evans et al. | 181/33 |
| 3,873,231 | 3/1975 | Callahan | 415/195 |
| 3,879,939 | 4/1975 | Markowski | 60/39.65 |
| 3,992,128 | 11/1976 | Lunsford et al. | 415/161 |
| 4,131,134 | 12/1978 | Lindberg | 137/808 |
| 4,175,640 | 11/1979 | Birch et al. | 415/119 X |
| 4,300,656 | 11/1981 | Burcham | 181/214 |
| 4,428,714 | 1/1984 | Mowill | 415/161 |
| 4,436,481 | 3/1984 | Linder | 415/163 X |
| 4,439,104 | 3/1984 | Edmonds | 415/161 |
| 4,531,356 | 7/1985 | Linder | 60/39.02 |
| 4,681,509 | 7/1987 | Davis | 415/DIG. 1 X |

FOREIGN PATENT DOCUMENTS

| | | |
|---|---|---|
| 1161481 | 1/1964 | Fed. Rep. of Germany . |
| 1259430 | 3/1961 | France .. |
| 373754 | 8/1939 | Italy . |
| 21281 | 9/1969 | Japan . |
| 50-123712 | 10/1975 | Japan . |
| 56-9622 | 1/1981 | Japan . |
| 293236 | 7/1928 | United Kingdom . |
| 366257 | 2/1932 | United Kingdom . |
| 579780 | 8/1946 | United Kingdom . |
| 1120240 | 7/1968 | United Kingdom . |
| 1206307 | 9/1970 | United Kingdom . |
| 1244292 | 8/1971 | United Kingdom . |
| 1287315 | 8/1972 | United Kingdom . |
| 1307867 | 2/1973 | United Kingdom . |
| 1432262 | 4/1976 | United Kingdom . |

OTHER PUBLICATIONS

Vortex Whistle: An Unsteady Phenomenon in Swirling Flow and Its Effects on Steady Flow Field by K. Kurosaka, "AIAA 19th Aerospace Sciences Meeting-"—Jan. 12-15, 1981.

A.P.C. publication, Baj, Ser. No. 344,165, published 5/1943.

*Primary Examiner*—Robert E. Garrett
*Assistant Examiner*—Joseph M. Pitko
*Attorney, Agent, or Firm*—Troxell K. Snyder

[57] ABSTRACT

A method and apparatus for eliminating vortex whistle noise in a radial-to-axial compressor intake uses a plurality of flow fences (36) disposed along the radially inner gas passage boundary (10). The fences (36) disrupt a portion of the swirling gas flow (32) resulting from the position of a plurality of pivotal inlet guide vanes (28) disposed about the radially outward facing inlet (18).

11 Claims, 2 Drawing Sheets

VARIABLE FLOW RADIAL COMPRESSOR INLET FLOW FENCES

FIELD OF THE INVENTION

The present invention relates to a method and an apparatus for eliminating flow instability in an intake for a variable flow radial compressor.

BACKGROUND

Intake structures for variable flow compressors frequently employ adjustable inlet guide vanes for imparting a varying swirl rate to the inlet air or gas. The swirl imparted by the inlet guide vanes has the effect of reducing the relative velocity between the inlet gas and the rotating compressor blades, thereby providing an effective method for modulating gas flow without changing the rotational speed of the compressor.

One particular type of intake structure for a radial compressor having an annular, axially facing inlet admits the inlet gas or air via a radially outward facing, circumferential intake opening The inlet gas flows radially inward through the intake and is turned axially by an annular gas flow passage defined between a radially inner hub wall and a radially outer wall. In this arrangement, the flow regulating inlet guide vanes are disposed circumferentially about the radially outward facing inlet and each vane pivots about a pivot axis generally parallel to the compressor shaft axis.

For maximum flow, the inlet guide vanes are arranged so as to each be aligned radially with respect to the compressor shaft axis, thereby admitting the inlet gas with a zero swirl angle. For reduced or modulated flow, the inlet guide vanes are turned in unison so as to impart a swirling motion to the inlet gas in the same angular direction as the rotating compressor, thereby reducing the relative velocity at the compressor inlet face and hence the gas flow.

At inlet guide vane angles of 45° or greater with respect to the radius, a flow instability has been found to arise which is manifested as an extremely loud, audible tone having a frequency of approximately 500 Hz, depending on the intake size and flow rate. A sound pressure level in excess of 100 decibels has been measured outside the intake. Measurements show that the tone is generated by a rotating pressure wave inside the intake and is accompanied by a radial, redistribution of gas total pressure and total temperature from the normal uniform distribution to a non-uniform distribution. Such phenomena are identical to the flow phenomena associated with the Ranque-Hilsch effect as described, for example, by Kuroska et al "'Vortex Whistle': An Unsteady Phenomenon in Swirling Flow and its Effects on Steady Flow Field", AIAA-81-0212, (1981).

It is extremely undesirable to operate a compressor intake, or any other turbomachine, in such a flow regime because the extremely loud tone is unacceptable for applications in or near personnel occupied locations.

Prior art compressor arrangements have utilized various means for suppressing such noise, as described in U.S. Pat. Nos. 4,436,481, 4,439,104, and 4,531,356 which provide one or more elongated tabs secured to the inlet guide vane cascade and extending radially inward into the gas flow passage immediately adjacent the gas inlet. The tabs in each of the above-identified patents are claimed to create a small zone of random turbulence in the radially outer portion of the vortex flow induced by the inlet guide vanes. As noted in each of the above references, the flow disruption is confined to the radially outer portion of the gas flow vortex and to one or more relatively small portions thereof. Such disruption apparently allows the intake device of the cited references to avoid the vortex whistle or Ranque-Hilsch effect.

SUMMARY OF THE INVENTION

An object of the present invention is to provide a means and a method for attenuating or eliminating flow instability and vortex whistle in a radial-to-axial gas intake having a plurality of swirl inducing vanes disposed about the inlet for modulating gas flow.

It is further an object of the present invention to provide a means for eliminating vortex whistle in a gas compressor having an associated gas intake disposed upstream of an axial compressor inlet and wherein the gas intake includes swirl inducing vanes pivotable for varying the swirl angle of the incoming gas.

It is further an object of the present invention to provide a variable flow radial compressor intake with vortex whistle eliminating means disposed along a radially inner portion of the intake gas flow and distributed about the inner circumference of said gas flow for disrupting a quantity of flow sufficient to eliminate the vortex whistle.

It is still further an object of the present invention to selectably accomplish such flow disruption by a plurality of flow fences, secured to an inner gas flow boundary of the intake device and extending at least halfway across the gas flow path, each fence being substantially planar and oriented to align with the gas flow during periods of full flow operation.

According to the present invention, a radial-to-axial compressor inlet having a plurality of swirl inducing flow regulating vanes is provided with a plurality of fixed flow fences which extend radially into a gas flow passage defined between two concentric walls. Each fence is planar in shape and aligned radially and axially with respect to the gas intake, intercepting a portion of the radially inner swirling gas flow. The fences according to the present invention inhibit the propagation and reinforcement of the rotating pressure wave, thus eliminating the source of the whistle tone and avoiding the Ranque-Hilsch effect discussed in the preceding section.

During full, or unmodulated, flow operation, the flow fences according to the present invention have a minimal impact on the entering gas flow which, by virtue of the fully open position of the inlet guide vanes, is unswirling. The gas flow therefore passes radially into the intake gas flow passage and is undisturbed as it is turned to axially enter the compressor inlet face. Full flow compressor operation is thus not affected by the presence of the flow fences according to the present invention.

Both these and other objects and advantages of the means and method according to the present invention will be apparent to those skilled in the art upon review of the following specification and the appended claims and drawing figures.

DETAILED DESCRIPTION OF THE PREFERRED EMBODIMENT

Figure 1:
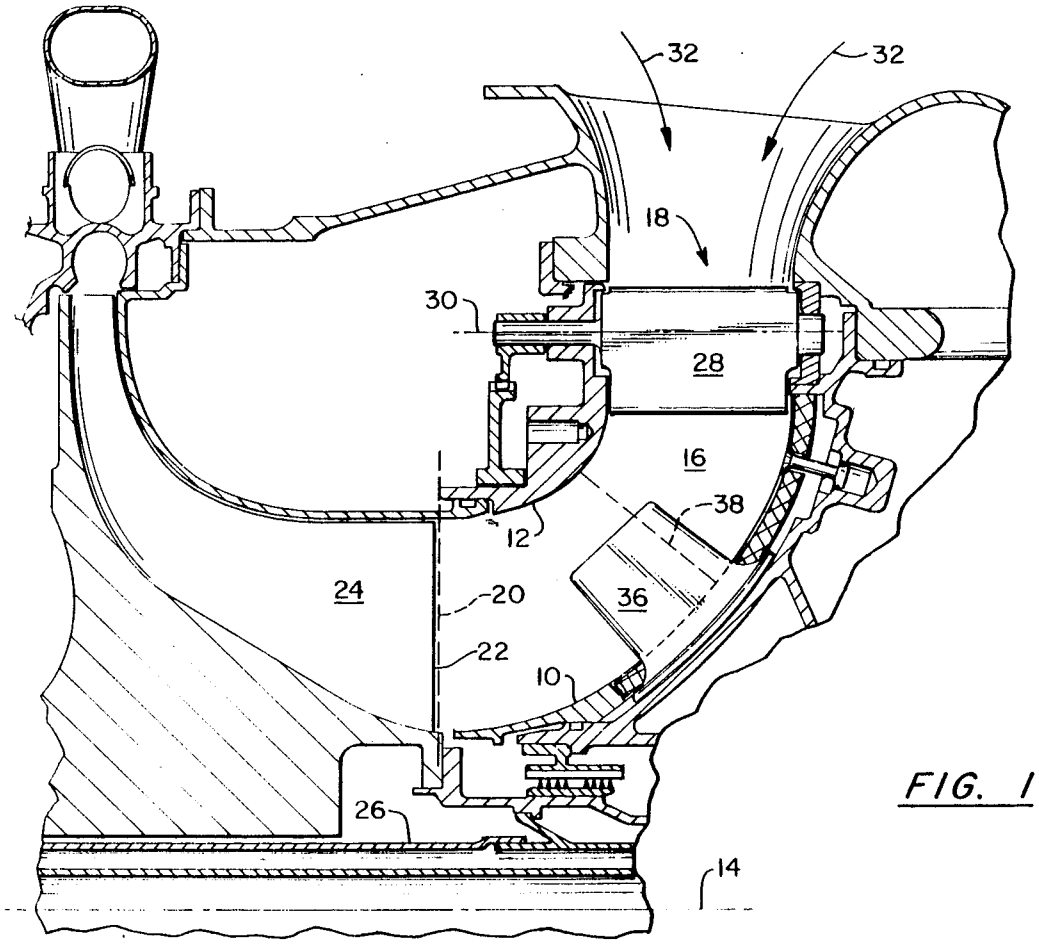
FIG. 1 shows a cross sectional view of the gas intake and compressor according to the present invention taken in a plane passing through the compressor shaft axis.

FIG. 1 shows a half plane axial cross section of an intake and compressor according to the present invention. The assembly comprises an inner wall 10 and a concentric outer wall 12 disposed about a central shaft axis 14. The walls 10, 12 define a gas flow passage 16 having a radially outward facing circumferential inlet 18 and an axially facing annular outlet 20. The outlet 20 of the gas flow passage 16 is coincident with the inlet face 22 of a radial compressor rotor 24. The rotor 24 is mounted on a shaft 26 and rotates about the central axis 14.

Disposed circumferentially about the radially outward facing inlet 18 are a plurality of variable position swirl inducing vanes 28 which are selectably pivotable about corresponding parallel axes 30. As noted in the preceding section, positioning the swirl vanes 28 varies the swirl angle of the incoming gas 32 thereby varying the relative velocity at the compressor inlet face 22 and hence modulating the volume flow of the gas or inlet air.

As also discussed hereinabove, at inlet swirl angles greater than approximately 45°, a high intensity audible tone is generated by the occurrence of a rotating pressure wave inside the intake and has a frequency of the order of 500 Hz. The tone, or vortex whistle, is accompanied by a gas flow instability as compared to the normal, free vortex flow pattern, and a transition to a forced vortex flow pattern occurs.

Figure 3:
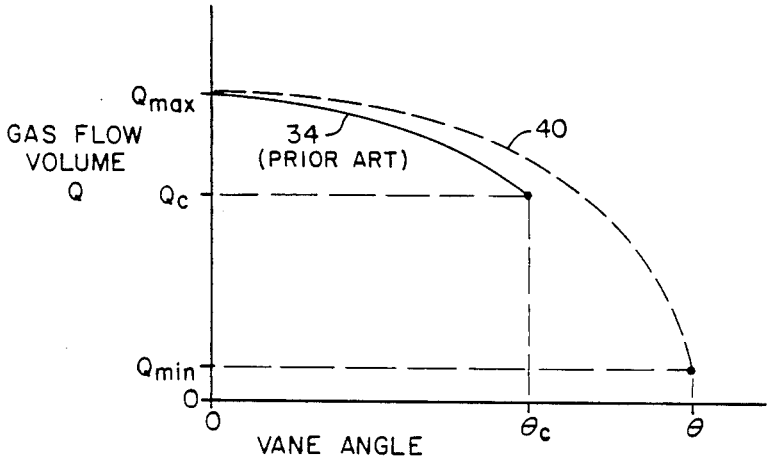
FIG. 3 shows gas volume flow as a function of guide vane angle for the intake according to the present invention and for a prior art intake.

The occurrence of the vortex whistle places a practical limit on the usefulness of the intake configuration as shown by curve 34 in FIG. 3 which represents gas flow volume Q versus inlet guide vane angle $\theta$. With respect to vane angle $\theta$, gas flow Q is at a maximum at zero vane angle wherein the gas enters the flow passage 16 without receiving any swirl from the inlet guide vanes 28. The gas thus flows radially inward, turning axially and entering the compressor inlet 22 without hinderance. As the vane angle is increased from zero, the swirl angle of the entering gas 32 increases, decreasing the relative velocity between the rotor 24 and the gas. Thus, gas flow volume Q diminishes as shown by curve 34.

At a critical vane angle $\theta_c$ (approximately 45°), the flow instability manifested by the Ranque-Hilsch effect occurs, resulting in the intense tone and the alteration of the vortex gas flow pattern discussed in the preceding section. Thus, $\theta_c$ represents the practical limit in prior art intake arrangements and the corresponding gas flow volume $Q_c$ the minimum compressor gas flow volume.

As will be appreciated by those skilled in the art, the limitation on the minimum gas flow volume can be, in certain applications, a severe drawback to compressor operation. For example, in an auxiliary power unit for an aircraft or the like wherein it is desired to provide both shaft power to an electric generator as well as variable air flow for auxiliary systems, air conditioning, etc., it is desirable to have the ability to reduce the air flow volume through the compressor to the lowest possible level during periods wherein the requirement for compressed air is zero while the requirement for electric power is high. Thus, the shaft 26 continues to spin the rotor 24 while the flow Q of the compressor is reduced to as low a level as practical to reduce compressor power and hence fuel consumption. For prior art compressors having the flow limitation shown in FIG. 3, excess air flow $Q_c$ must be dumped or otherwise bypassed from the aircraft, incurring an added fuel consumption penalty as well as requiring increased noise suppression of the vented air.

The intake arrangement according to the present invention inhibits the reinforcing pressure wave and hence the tone associated with the Ranque-Hilsch effect by means of a plurality of flow fences 36 secured to the inner wall 10 of the gas flow passage 16 and extending transversely with respect to the gas flow 32. Each flow fence 36 is substantially planar, and each is oriented so as to extend both radially and axially with respect to the central axis 14. It must also be noted that the fences 36 may be oriented other than in the plane of the central axis should the compressor design require pre-swirling inlet flow at the full flow design point. The fences are thus oriented so as to not interfere with the intake gas flow at the full flow conditions.

Figure 2:
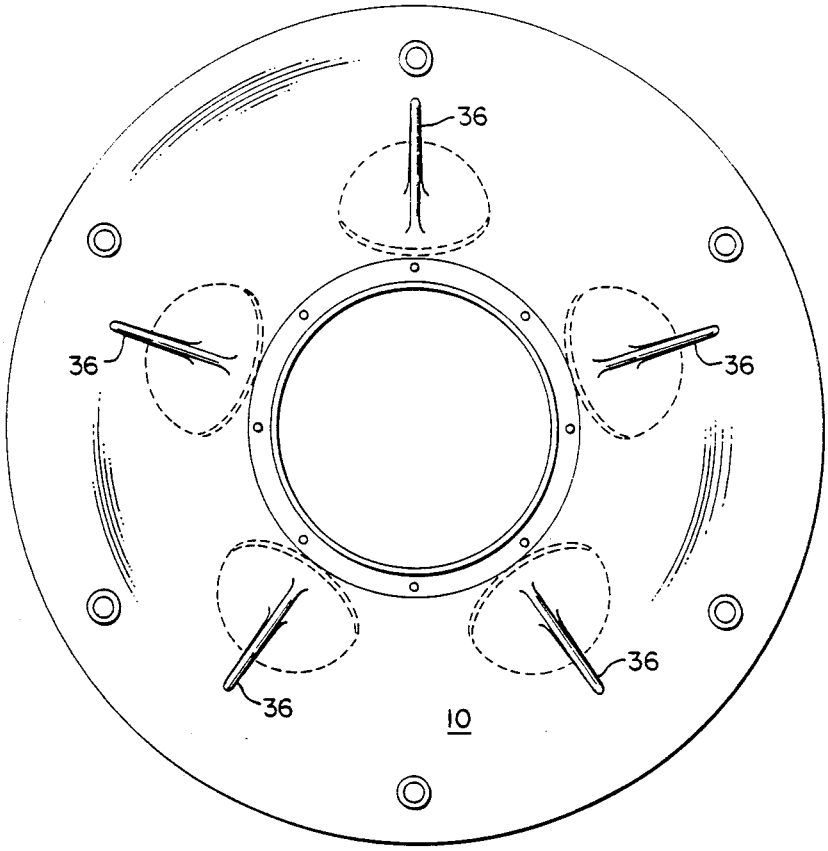
FIG. 2 shows a radial cross section looking upstream into the gas flow passage as indicated in FIG. 1.

A plurality of such flow fences 36 are disposed equally circumferentially spaced about the axis 14 as shown in FIG. 2, thereby inhibiting the propagation of the rotating pressure wave which in turn gives rise to the vortex whistle tone. The fences 36 extend across the gas flow 32 transversely for a distance at least as great as 50% of the local flow height of the gas flow passage 16 indicated by the broken line 38 in FIG. 1. Five such fences are used in the preferred embodiment shown in FIG. 2, having been found by experimental testing to be completely effective in eliminating the vortex whistle tone throughout the compressor operating range.

The effect of the flow fences according to the present invention on the turndown capability of the compressor is clearly evident from curve 40 as shown in FIG. 3. At any given vane angle $\theta$ the curve 40 lies slightly above the prior art curve 34 in terms of flow volume, however the intake with the flow fences 36 according to the present invention is operable at greater vane angles $\theta$ than the prior art intake assembly thereby allowing the compressor and intake combination to be turned down to a far lower flow rate $Q_{min}$ as shown in FIG. 3. The angle $\theta_{min}$, is approximately 75°, and is a function of the geometry of the individual inlet guide vanes 28 which are typically arranged so as to overlap in the closed position. The fences 36 do not affect the maximum gas flow rate wherein the inlet gas 32 flows without swirl into the compressor inlet face 22.

With regard to the size of the flow fences 36, it has been found that the most effective transverse height is between 50 and 75% of the local gas flow passage height 38. The effectiveness of the fences 36 increases with the transverse height and thus may be adjusted depending upon the severity of the tone and flow instability in a particular intake arrangement.

With regard to the axial location of the fences 36 according to the present invention, experimental observation has determined that the rotating pressure wave in prior art intakes reaches a maximum amplitude in a region of the intake spaced apart from the compressor inlet face 22. Placing the fences in this region blocks propagation and reinforcement of the pressure wave thus eliminating the tone noise and occurrence of the Ranque-Hilsch effect. Locating fences 36 adjacent the compressor inlet face 22 has been found ineffective in eliminating vortex whistle Thus, a central location as shown in FIG. 1 has been selected for the preferred embodiment of the present invention.

The intake arrangement of the present invention is thus well suited for suppressing the flow instability and rotating pressure wave resulting from high swirl angles in a radial-to-axial gas flow intake structure. By interrupting a portion of the circumferential flow of swirling gas adjacent the radially inner or hub wall 10, the inlet passage according to the present invention avoids the vortex instability and intense tone noise associated with the Ranque-Hilsch effect.

It should further be noted that although disclosed and claimed in terms of the preferred embodiment represented in the accompanying figures, the embodiment disclosed herein is merely illustrative of only one of a plurality of equivalent, equally effective configurations which will occur to those skilled in the art and is hence not to be construed as limiting the scope of the invention which is defined solely by the claims presented hereinafter

We claim:

1. Variable flow rate intake apparatus adapted for connection to a gas compressing device having an annular inlet opening, said intake apparatus having an axis and comprising:

(a) radially inner first and radially outer second mutually spaced, concentric walls circumscribing said axis and defining therebetween a gas flow passage having a generally axially facing annular outlet and a generally radially outwardly facing inlet encircling said axis;

(b) a circumferentially placed plurality of adjustable inlet guide vanes extending between said first and second walls around the flow of passage inlet for pivotal motion about corresponding axes generally parallel to said axis of said intake apparatus, the plurality of guide vanes being operable to vary the flow rate of gas entering said device and to cause the entering gas to assume a vortex pattern as the gas traverses the flow passage; and (c) a plurality of flow fences distributed circumferentially about the first wall and extending radially outward across at least 50% of the local height of the gas passage.

2. The apparatus as recited in claim 1, wherein said flow fences are generally planar and are each oriented in a corresponding plane passing through the axis.

3. The apparatus as recited in claim 2, wherein the plurality of flow fences are five in number.

4. The apparatus as recited in claim 1, wherein the flow fences extend at no more than 75% across the local height of the gas flow passage.

5. The apparatus as recited in claim 1, wherein the plurality of flow fences are spaced radially and axially apart from the generally outwardly facing inlet.

6. The apparatus as recited in claim 1, wherein the plurality of flow fences are oriented to coincide with the gas flow within the gas passage when the inlet guide vanes are operated to admit a maximum gas flow to the gas compressing device.

7. A method of attenuating vortex whistle noise in a gas intake device having an axis, a generally radially outwardly facing inlet opening circumscribing the axis, a gas flow passage communicating with the inlet opening and having a generally axially facing discharge end, and a circumferentially spaced plurality of inlet guide vanes positioned around the inlet opening for causing gas entering the inlet opening to swirl about the axis in a vortex flow pattern circumscribing the axis as the gas traverses the flow passage, said method comprising the steps of:

(a) providing a plurality of vortex-disturbing members adapted to intercept a radially inner portion of the vortex flow within the flow passage for significantly disrupting the gas flow adjacent the radially inner gas flow boundary, and (b) securing said plurality of vortex-disturbing members to the intake device so that the member extends at least 50% across the gas flow passage.

8. The method as recited in claim 7, wherein the step of providing a plurality of vortex disturbing members includes the steps of:

providing a plurality of substantially planar flow fences, each fence oriented to lie in a corresponding axial plane, and positioning said flow fences radially inward of the inlet opening and axially spaced apart therefrom.

9. The suppressing means as recited in claim 5, wherein the plurality of flow fences is five in number.

10. The suppressing means as recited in claim 9, wherein the five fences are distributed uniformly about the shaft axis.

11. A means for suppressing inlet vortex tone noise in an axially symmetric, concentric walled, radial-to-axial inlet gas flow passage having a radially inner wall and a radially outer wall, comprising:

a plurality of flow fences, secured to the radially inner wall, each fence being substantially planar, aligned with the axis of symmetry, and extending transversely across at least 50% of the local gas flow passage height.

* * * * *